US005318474A

United States Patent [19]

Klassen et al.

[11] Patent Number: 5,318,474

[45] Date of Patent: Jun. 7, 1994

[54] RADIAL FLOW DIFFUSER

[75] Inventors: Walter D. Klassen; Brian C. Watson, both of Winnipeg, Canada

[73] Assignee: E. H. Price Limited, Winnipeg, Canada

[21] Appl. No.: 913,916

[22] Filed: Jul. 17, 1992

[51] Int. Cl.[5] ..... F24F 13/075

[52] U.S. Cl. ..... 454/296

[58] Field of Search ..... 454/292, 296, 297, 298

[56] References Cited

U.S. PATENT DOCUMENTS 4,616,558 10/1986 Ball et al. ..... 454/297
5,054,379 10/1991 Sodec ..... 454/296
5,069,114 12/1991 Sodec et al. ..... 454/297

FOREIGN PATENT DOCUMENTS 378497 7/1964 Switzerland ..... 454/296

*Primary Examiner*—Harold Joyce
*Attorney, Agent, or Firm*—Blake, Cassels & Graydon

[57] ABSTRACT

A device to produce a high capacity, low velocity, non-aspirating, semi-cylindrical air pattern, to be mounted in a ceiling. The device has a box-shaped backpan connected to a ceiling air duct and a flow directing assembly attached to the backpan and hanging below the ceiling. The flow directing component has a perforated face panel made up of flat surfaces in horizontal and angular planes, forming a substantially semi-cylindrical shape. Inside the face panel are four vanes that span its length, for controlling the direction of air flow. The flow directing assembly can swing away from the ceiling by a hinge along one side, or can be removed entirely using quick release means.

21 Claims, 13 Drawing Sheets

RADIAL FLOW DIFFUSER

FIELD OF THE INVENTION

This invention relates to air distribution devices for the creation of a non-turbulent flow of air in a room. The flow created is non-aspirating, i.e., the supply air does not mix with the room air. Thus, particulates and other contaminants are not recirculated, but are removed with exhaust air. The flow of supply air is also radial, meaning that it is substantially uniformly distributed through an arc of 180° when viewed from an end of the device. This invention is appropriate for critical high volume applications where high air change rates are required. Typical applications would be laboratories, clean rooms, hospital rooms, animal laboratories, kitchens and computer rooms.

BACKGROUND OF THE INVENTION

A variety of ceiling- or wall-mounted air distribution devices or diffusers are known that supply ducted air to the room in which they are mounted. These devices generally have an air inlet connecting to the duct system and an air outlet with flow-directing features such as vanes, baffles and/or a perforated face plate. The flow-directing component may be mounted directly to the inlet duct. Alternatively, the air supplied by the inlet duct may be collected in a plenum chamber in the wall or ceiling prior to distribution in the room. The air pressure of the plenum is greater than that of the outside atmosphere.

Conventional "horizontal" air flow diffusers are generally mounted above a ceiling with the face of the flow directing component co-planar with the ceiling. Typically, directional vanes are used to deflect air horizontally through perforations in the face of about 3/16 in. in diameter. This relatively large perforation size permits the supply air to issue from most of these devices in jets with high initial velocity. The air throw, or maximum distance from the outlet at which a specified air velocity can be measured, that is produced is relatively long. The Jets induce the room air and achieve its mixing with the supply air. However, at the large volumes required for high air change rates, these high jet velocities can produce unacceptably high room air velocities.

Laminar flow diffusers that provide "vertical" air flow are also typically mounted in a ceiling with the face coplanar with the ceiling. A deflector in the plenum above the face directs air vertically through perforations in the face that are smaller than those in horizontal air flow diffusers, generally about 1/16 in. in diameter. This smaller aperture size offers significant resistance to the supply air. Consequently, the supply air tends both to fill the plenum more completely than in a device with larger perforations, and to expand more completely across the face of the diffuser as it issues. This results in lower initial face velocity and less entrainment of the room air than would occur with high velocity jets. Thus, in contrast to horizontal diffusers, laminar flow diffusers typically have very low initial velocities, short throws, and low levels of aspiration.

Another type of air diffuser is the "trough" type diffuser, introduced by E.H. Price Limited of Winnipeg, Manitoba in the 1970's, which has a flow directing component that suspends below the ceiling in a triangular prism shape. The flow directing component has vanes to direct air horizontally, and fits directly below the ceiling air duct, with no plenum in between. This device generally has a face with larger perforations, of about 3/16 in. in diameter. The Model GFY high capacity diffuser made by the Barber-Colman Company of Rockford, Ill. uses a similar design for two-way horizontal air distribution.

More recently introduced diffusers create a "radial" or semi-cylindrical flow of air into the room. These are designed to meet the need for high capacity, non-mixing air distribution.

One such device is the Duct-D-fuser TM made by United Sheet Metal Division of United McGill Corporation, Columbus, Ohio. This device is essentially the extension of a cylindrical metal air duct into a room. The end of the duct in the room is closed off and the portion of the duct in the room has one of a variety of perforation patterns in its sides. This device is intended primarily for industrial applications.

Another diffuser that can produce a radial flow is the Fusa-Vent TM made by Precision Air Products Company of Delano, Minn. This device has a trapezoidal diffuser cage that is installed directly below a ceiling air duct. Adjustable air deflectors are mounted inside the diffuser cage along the two edges where bottom wall meets side walls. The deflectors can be positioned to produce horizontal, vertical or intermediate air patterns. The diffuser may further be adjusted by raising or lowering its orifice cover, which is spring-mounted.

A third type of radial diffuser is described in U.S. Pat. No. 4,616,558 and Canadian Patent No 1,234,312, and sold by Krueger of Tucson, Ariz. and Krueger Air Canada of Weston, Ontario. This device has a box-shaped plenum for installation above the ceiling and a flow directing assembly that suspends below the plane of the ceiling. The bottom wall of the plenum that separates these two components is perforated. The flow directing assembly has a perforated face interior to which are curved directional vanes. Perforation size is of the range of 1/16 to 3/16 in. in diameter. The face is semi-elliptical in cross section with side wall portions that are inclined inwardly from the vertical at the top. The inwardly inclined portions allow air flow to be directed in paths generally parallel to the ceiling, whereas the overall pattern of air flow is radial. The patent specification describes a horizontal, adjustable perforated baffle of approximately the same dimensions as the air duct for placement inside the plenum.

Devices that use circular or curved perforated screens, as these radial diffusers do, have not been generally well accepted in the air distribution industry, primarily due to high tooling costs and limited application to commercial office space.

Certain other air distribution devices are described below to present an overview of the known art.

U.S. Pat. No. 3,084,609 describes a filter diffuser that produces a semi-spherical air distribution pattern, with an inverted dome shape made of multi-ply expanded aluminum sheets or foil. The device is mounted directly below an air duct with no intervening plenum. According to the disclosure, the air passing through the filter is distributed at all angles in the room without the use of baffles or directional vanes. A metal disc is located in the bottom of the dome to prevent air discharge directly downward. In another embodiment, the filter diffuser may have a basket or dishpan shape.

U.S. Pat. No. 3,548,735 describes an air distribution device that is mounted in the ceiling directly below an air duct so that the perforated outlet is coplanar with the ceiling. The device has a plurality of pivotal directional vanes that may be arranged in different patterns for one, two, three, or four-way and vertically downward air distribution.

U.S. Pat. No. 3,559,560 describes a ceiling box for downward air distribution that is installed below an air duct. The bottom of the box is a grille that is substantially flush with the ceiling, through which air is discharged to the room. An end or side wall of the ceiling box is secured to a ceiling joist. The box walls have at their bottom an inwardly projecting flange that supports the grille.

U.S. Pat. No. 4,034,659 describes an array of air diffusion modules, wherein, according to the disclosure, the air flow of each module can be monitored and adjusted to produce a balanced distribution of air from all the modules. This is achieved for each module by a valve controlling the admission of pressurized air into an upper control plenum located above a lower distribution plenum. At the bottom side of each module's lower distribution plenum is a perforated diffusion plate that is contiguous with the ceiling. The diffusion plate is hingedly attached, and may swing down to a vertical position to allow access to the interior. A perforated deflection angle plate with two outwardly and downwardly extending legs exists on the interior of the perforated diffusion plate and swings down with it.

U.S. Pat. No. 4,693,176 describes an air outlet for room conditioning systems to be mounted in a ceiling directly below an air intake duct. This device requires fixed vertical deflectors below the duct that extend downward to the plane of the ceiling. Below the ceiling plane are pivotal slats in the casing portion of the device. Each slat is composed of two vanes that form an obtuse angle, and is pivotal about their junction point. The vanes are unequal in width, with the upstream vane of each slat being shorter in the air flow direction. According to the disclosure, this device has a perforated plate below the air duct and above the fixed deflectors.

U.S. Pat. No. 5,054,379 describes an air release box with a box housing having at least one perforated bottom wall and two perforated side walls, as well as end walls that are not perforated. The side and end walls connect to the cover that carries the connection air inlet. Spin outlet means are arranged in at least the central perforated bottom wall section and in the perforated side wall sections. Two baffle guide plates extend from the bottom walls toward the air inlet. The baffle plates are hingedly attached and angularly adjustable.

SUMMARY OF THE INVENTION

The present invention provides, in one broad aspect, an air distribution device for use with an air inlet opening in a ceiling of a room, having a box-shaped backpan assembly that connects to the air inlet opening and a flow directing assembly. The flow directing assembly has a multi-angular perforated face, two end caps, each of which is attached to an end of the perforated face, and directional control vanes that substantially span the length of the perforated face and are fixedly mounted within the flow directing assembly. The backpan assembly is installed above the plane of the ceiling, and the flow directing assembly is suspended below the backpan assembly and below the plane of the ceiling in such a way that substantially all of the air flow passes through the perforations. The multi-angular perforated face and the directional control vanes are arranged to produce a substantially radial (180°) air flow pattern when the device is viewed from an end.

The multi-angular perforated face of the air distribution device may have a flat, substantially rectangular bottom wall and a plurality of flat, substantially rectangular side walls, such that side edges of the bottom wall are attached to side edges of side walls; the side walls cant upwardly and outwardly from the bottom wall; and the outermost side wall at each of the two sides of the perforated face is substantially vertical.

The directional control vanes of the air distribution device may be substantially rectangular. They may be fixedly attached at each end to an end cap.

The air distribution device may have four directional control vanes, where two directional control vanes are located closer to the middle of the flow directing assembly than are the other two.

The two directional control vanes closer to the middle of the flow directing assembly may be canted upwardly and outwardly at an angle of approximately 40° to 60° from the vertical, with the other two directional control vanes canted upwardly and outwardly at an angle of approximately 80° to 100° from the vertical.

The two directional control vanes closer to the middle of the flow directing assembly may be canted upwardly and outwardly at an angle of approximately 51° from the vertical, and the other two directional control vanes at an angle of approximately 90° from the vertical.

The air distribution device may have the structure wherein the two side walls of the perforated face that are attached to either side of the bottom wall of the face are each canted upwardly at approximately 110° from the vertical; the two side walls that are attached to the side walls at approximately 110° from the vertical are each canted upwardly at approximately 144° from the vertical; and the two side walls that are at approximately 144° from the vertical are attached to the two outermost side walls that are substantially vertical.

The perforations of the face panel of the air distribution device may be of the size ranging from approximately 1/16 inch in diameter to approximately 3/16 inch in diameter. The area of the face panel having perforations may be in the range of 5% to 55%.

The backpan assembly of the air distribution device may be hingedly attached to the flow directing assembly.

In a second broad aspect, the present invention provides an air distribution device for use with an air inlet opening in a ceiling of a room, comprising a box-shaped backpan assembly for connection to the air inlet opening, and a flow directing assembly. The flow directing assembly has a multi-angular perforated face, two end caps, each of which is attached to an end of the perforated face, and directional control vanes that substantially span the length of the perforated face and are fixedly mounted within the flow directing assembly. The backpan assembly is installed above the plane of the ceiling, and the flow directing assembly is suspended below the backpan assembly and below the plane of the ceiling in such a way that substantially all of the air flow passes through the perforations. The multi-angular perforated face and the directional control vanes are arranged to produce a substantially 90° air flow pattern when the device is viewed from an end.

The multi-angular perforated face of this aspect of the invention may have a flat, substantially rectangular bottom wall and a plurality of flat, substantially rectangular side walls, such that side edges of the bottom wall are attached to side edges of side walls; the side walls on one side of the bottom wall cant upwardly and outwardly from the bottom wall, with the outermost side wall on this side being substantially vertical; and attached to the other side of the bottom wall there is a substantially vertical side wall.

The directional control vanes of this air distribution device may be substantially rectangular. They may be fixedly attached at each end to an end cap.

The perforations of the face panel may be of the size ranging from approximately 1/16 inch in diameter to approximately 3/16 inch in diameter.

The backpan assembly of the air distribution device may be hingedly attached to the flow directing assembly.

DETAILED DESCRIPTION OF PREFERRED EMBODIMENTS

Figure 1:
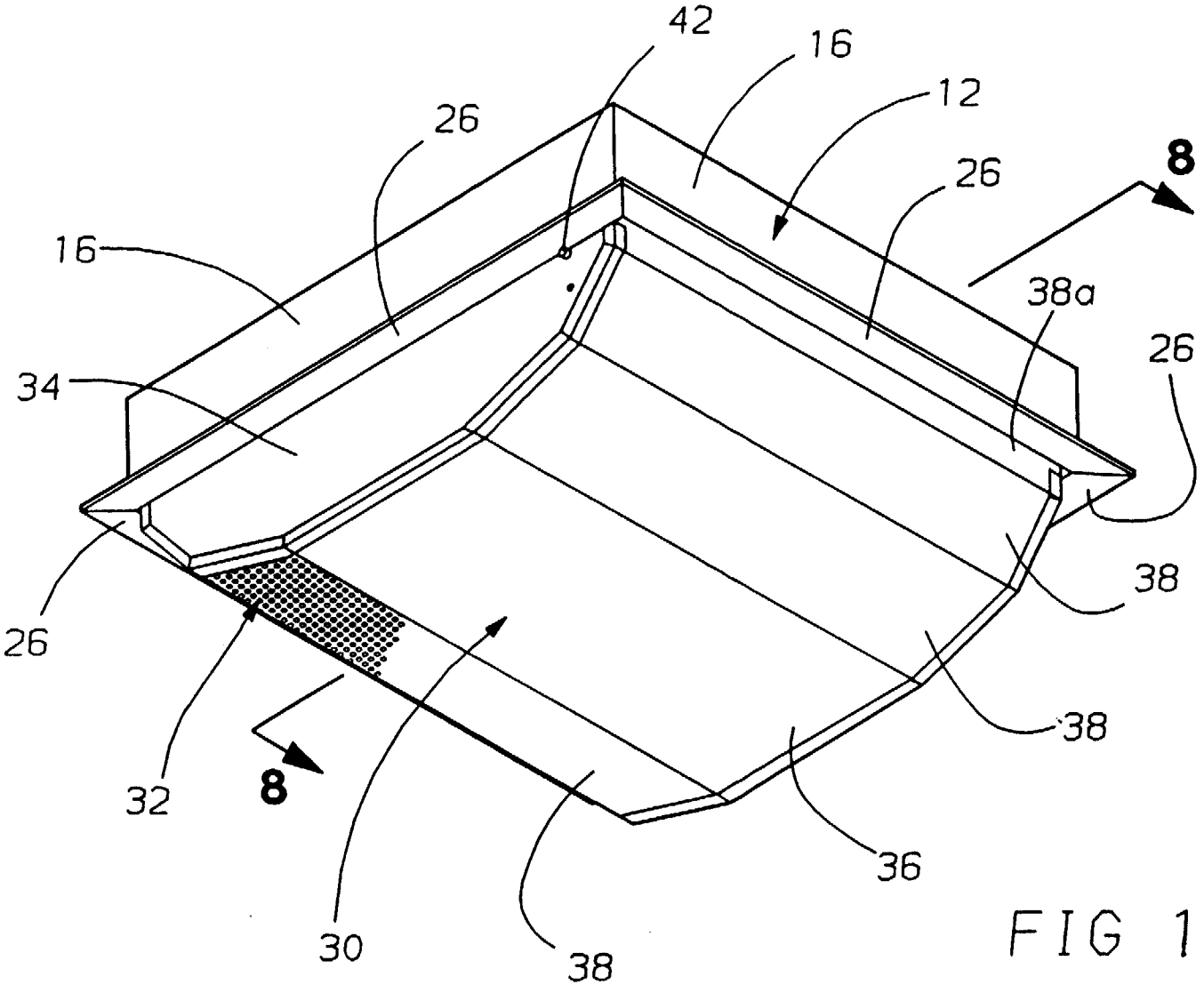
FIG. 1 is a perspective view from below of a preferred embodiment of the invention for 180° air flow in its functioning configuration.

FIG. 1 illustrates a preferred embodiment of the radial flow diffuser of the present invention. It is composed of a box-shaped backpan assembly 12 for mounting in a ceiling and a flow directing assembly 30 that suspends below the backpan assembly 12 and the ceiling.

Figure 2:
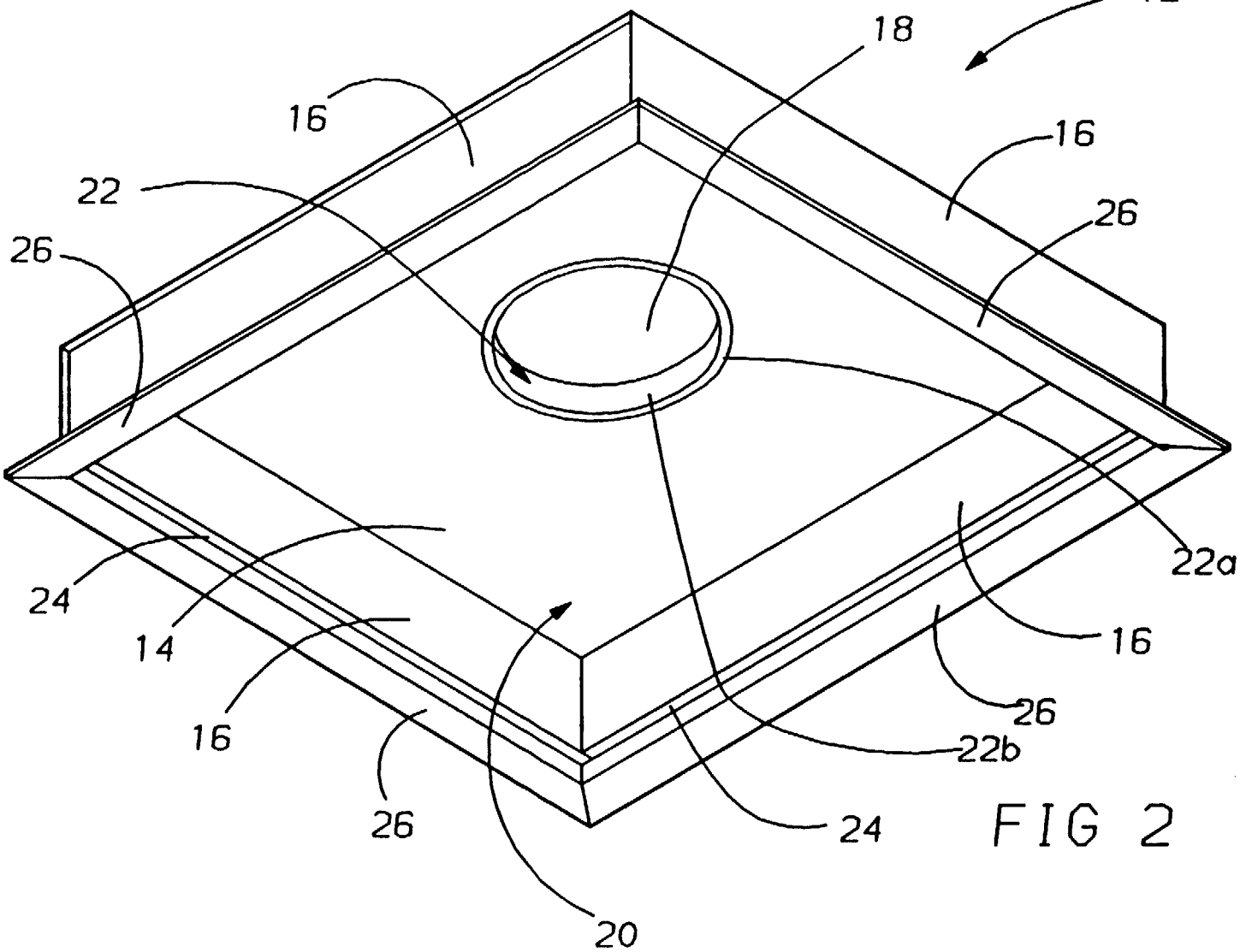
FIG. 2 is a perspective view from below of the backpan assembly of a preferred embodiment of the present invention.
Figure 3:
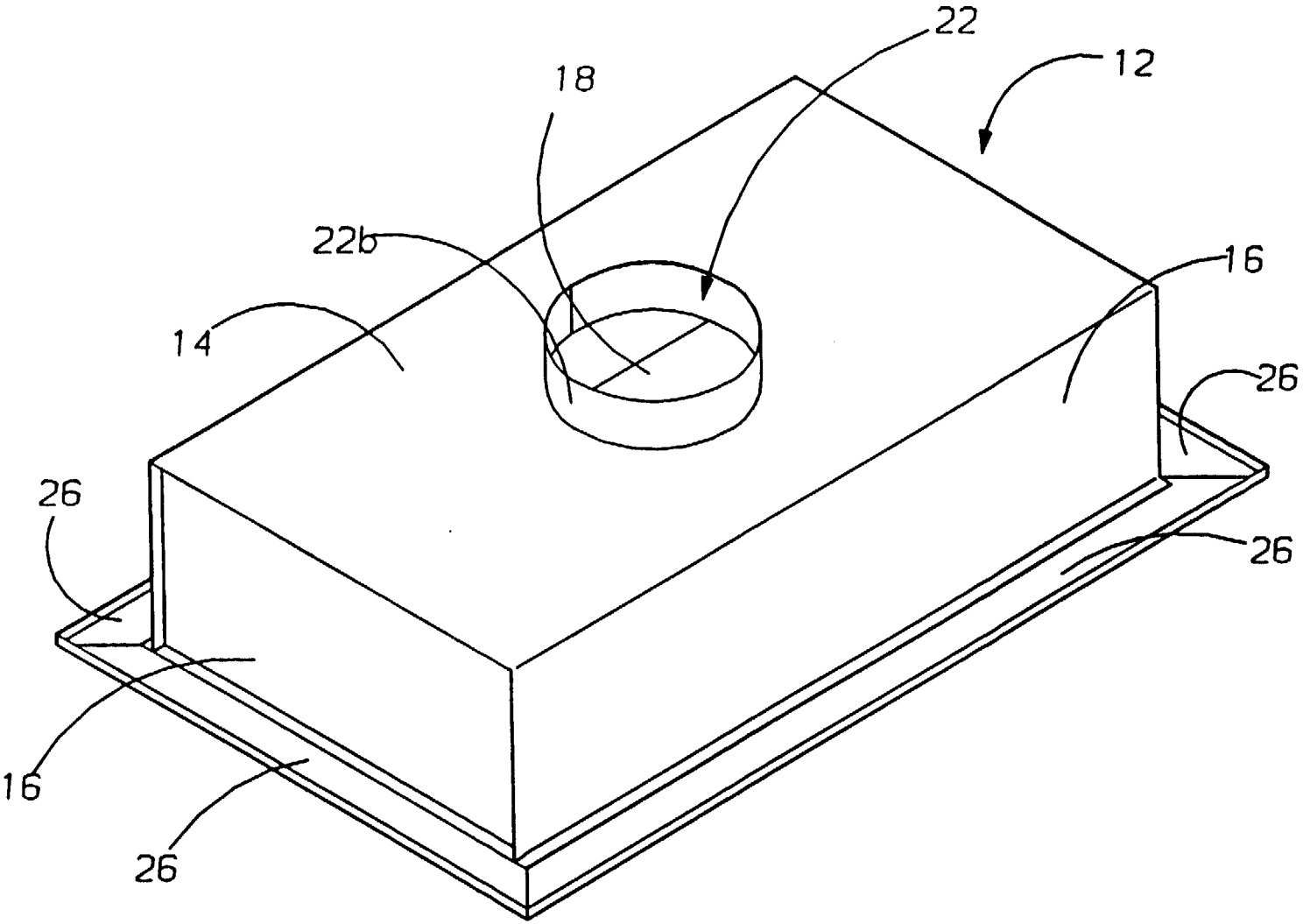
FIG. 3 is a perspective view from above of the backpan assembly of FIG. 2.
Figure 4:
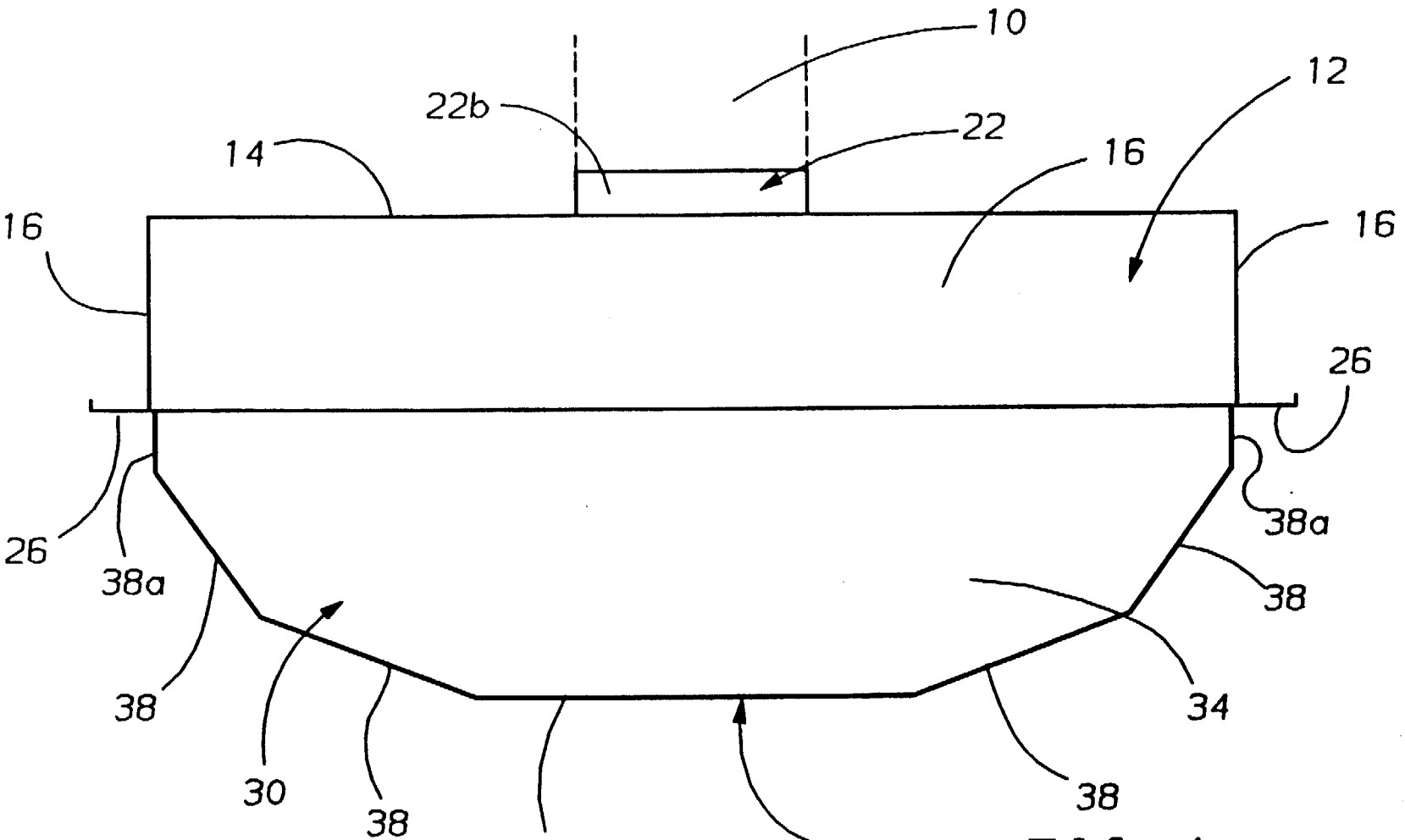
FIG. 4 is a plan view from the end of the preferred embodiment of FIG. 1.
Figure 5:
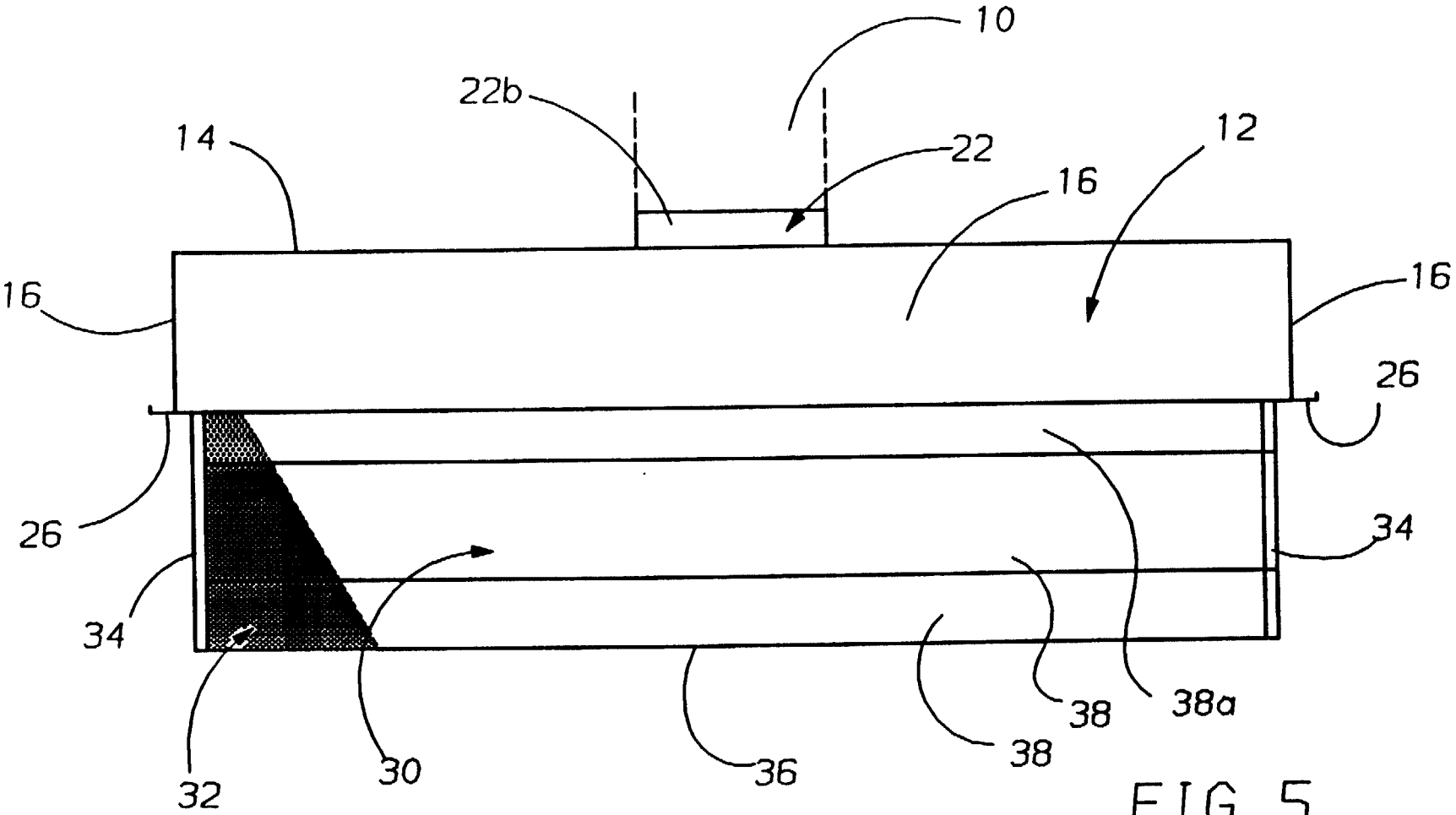
FIG. 5 is a plan view from the side of the preferred embodiment of FIG. 1.
Figure 6:
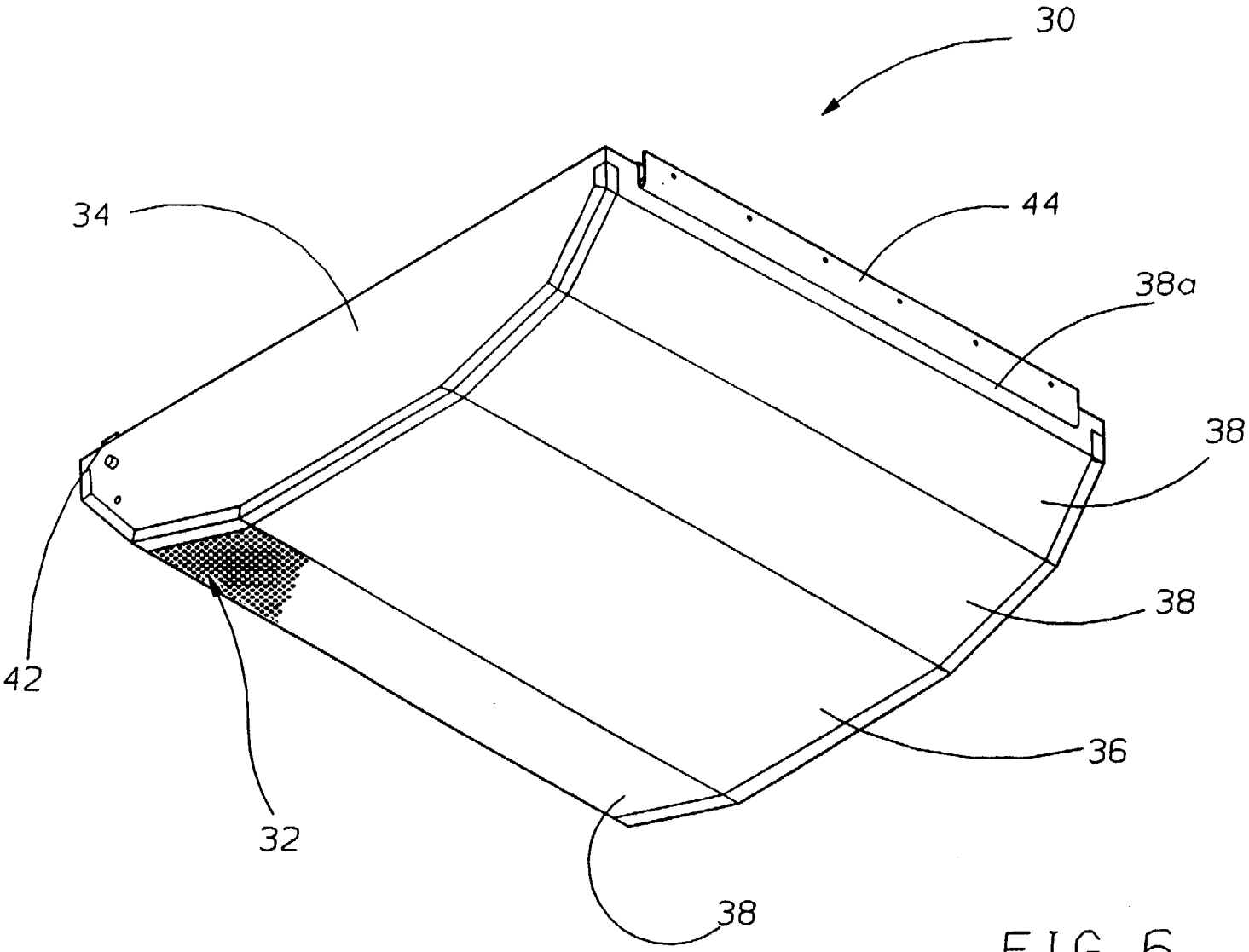
FIG. 6 is a perspective view from below of the flow directing assembly of the preferred embodiment of FIG. 1.

FIGS. 2 and 3 show in isolation the backpan assembly 12, which has a top wall 14 and four side walls 16. The space within the walls 14,16 of the backpan assembly 12 is a plenum 20 for the collection of pressurized air. An air duct 10 (not shown in FIGS. 2 and 3, but in FIGS. 4 and 5) that supplies clean, conditioned air is located in the ceiling and connects to the backpan assembly via an opening 18 in its top wall 14. The opening 18 to the duct 10 is fitted with an inlet collar 22 whose diameter is slightly smaller than that of the duct 10. The inlet collar 22 has a horizontal flange **22*a* at its base, which extends beyond the opening 18 and into the plenum 20. Vertical side walls 22*b* of the inlet collar 22 project above the top wall 14 of the backpan assembly 12 and into the air duct 10**.

Near the base of three of the side walls 16 of the backpan assembly 12 and spanning their length is an inwardly projecting horizontal flange 24. At the base of all four side walls 16 and spanning their length is an outwardly projecting horizontal flange 26. The outwardly projecting flange 26 fits just below the plane of the ceiling. The flow directing assembly 30 of the radial flow diffuser is mounted below the inwardly projecting flange 24 such that the flow directing assembly 30 suspends below the ceiling. Unlike certain more complicated prior art devices, there are no baffles or plates in the plenum 20 or between the backpan assembly 12 and the flow directing assembly 30.

The external portion of the flow directing assembly 30 (shown in FIGS. 4, 5 and 6) comprises a perforated face panel 32 and two end caps 34. (A portion of the perforated area is indicated in FIGS. 1 and 5–7.) The perforated face panel 32 has a horizontal bottom wall 36 and a plurality of side walls 38. The side walls 38 connect to the bottom wall 36 and to each other such they are canted progressively upwardly and outwardly in a symmetrical fashion relative to the longitudinal axis of the horizontal bottom wall 36 and of the entire flow directing assembly 30. Each of the two final side walls **38*a* that connect to the backpan assembly 12 is substantially vertical, i.e., perpendicular to the ceiling. The end caps 34 of the flow directing assembly 30 are vertical walls that attach to the ends of the bottom wall 36 and the side walls 38, 38*a* of the perforated face panel 32** and are not themselves perforated.

The size of the perforations of the bottom wall 36 and the side walls 38 is carefully chosen to minimize the mixing of the supply air and the room air, while producing a substantially uniform radial flow of supply air. This size may depend on the size of the room, the room's configuration, etc. In general, perforation size may range from 1/16 inch diameter with approximately 5% of the surface of face panel 32 perforated to 3/16 inch diameter with approximately 51% of the surface perforated. In a preferred embodiment of the invention, the perforations are 3/32 inch in diameter, with approximately 10% of the surface perforated.

Figure 7:
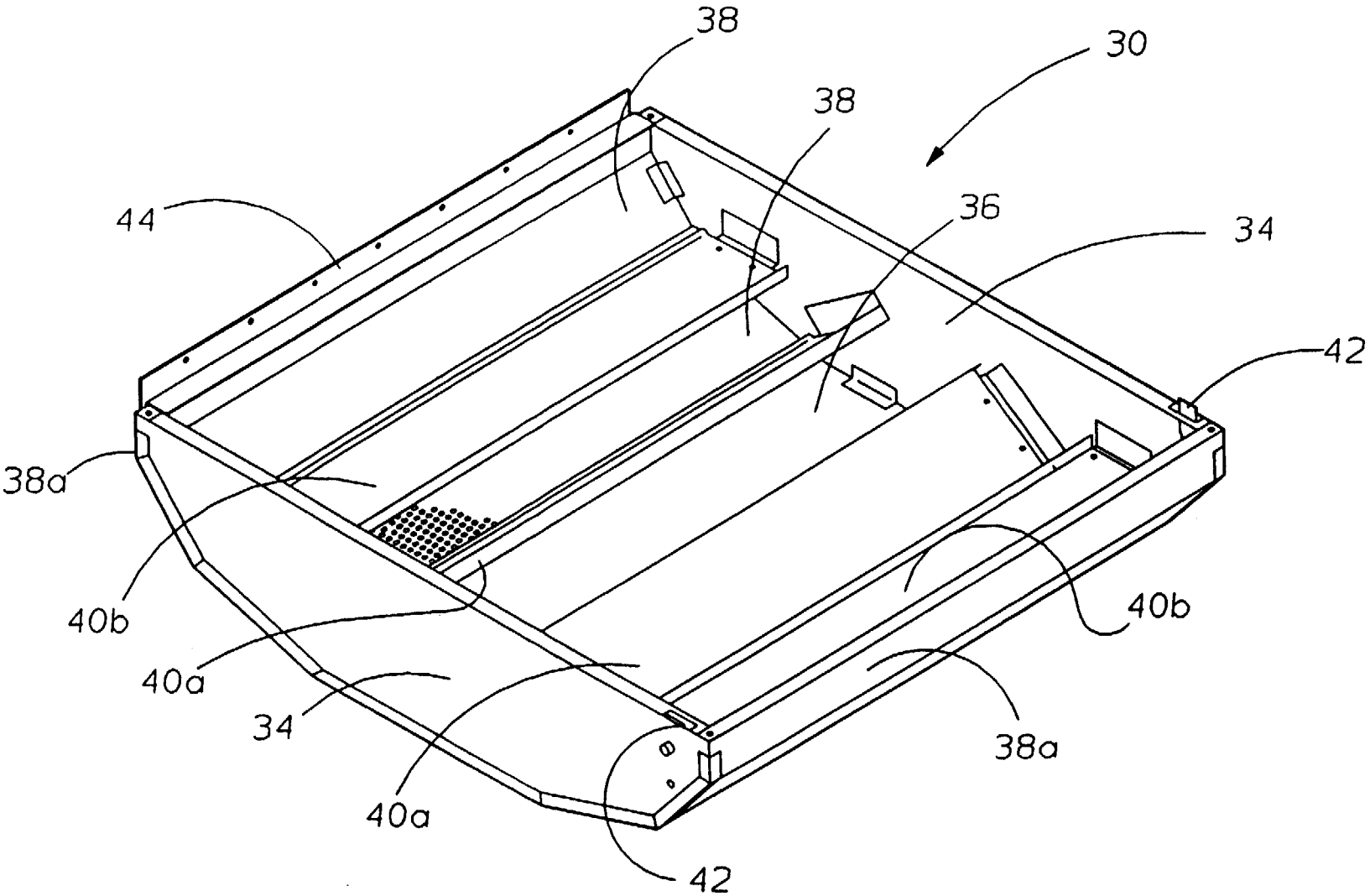
FIG. 7 is a perspective view from above of the flow directing assembly of FIG. 6.
Figure 8:
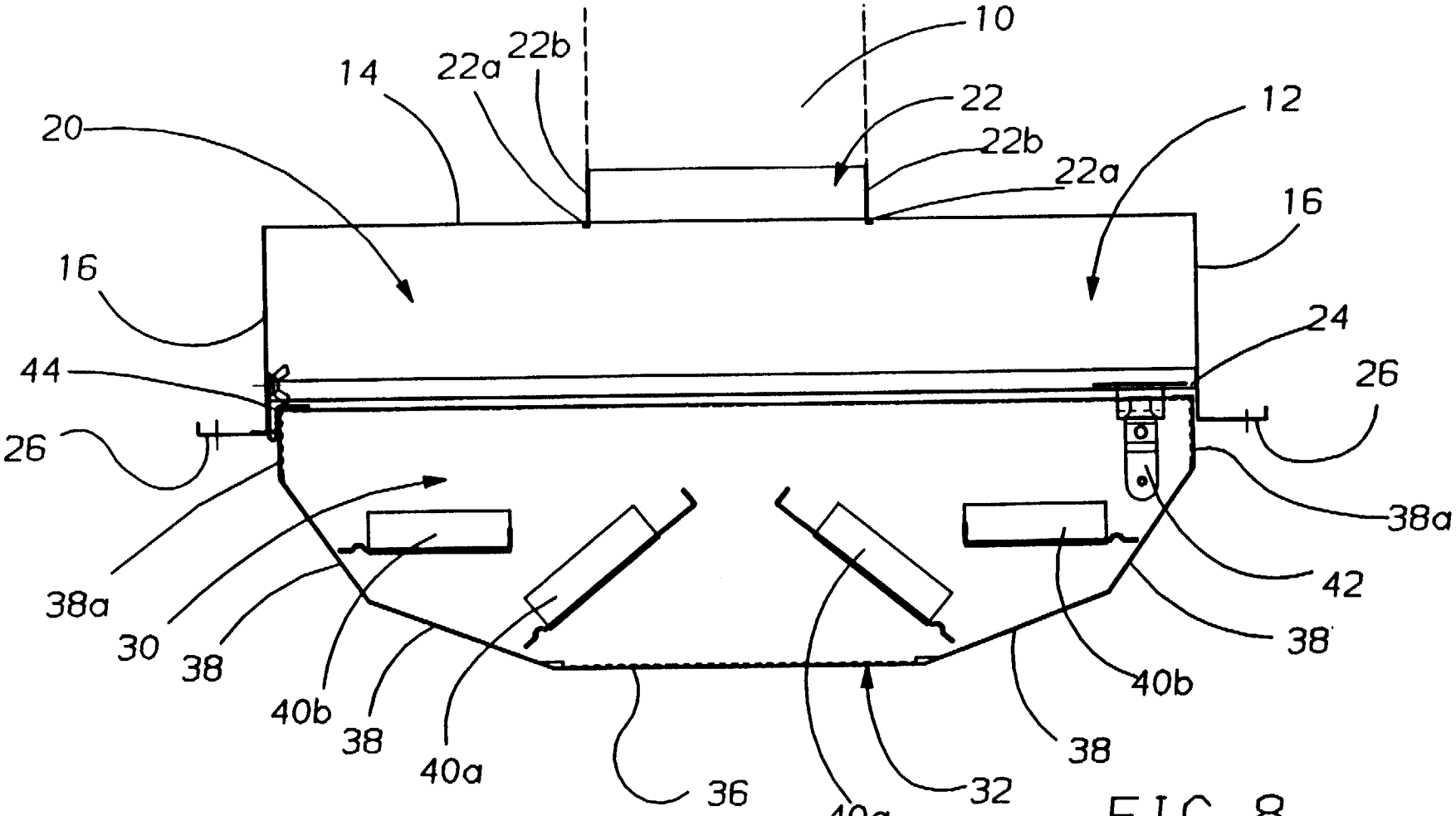
FIG. 8 is a cross-sectional view as indicated by the arrows 8—8 in FIG. 1.

The interior of the flow directing assembly 30, shown in FIGS. 7 and 8, has a plurality of directional control vanes 40, each of which spans the length of the perforated face panel 32 and is fixedly attached at each end to an end cap 34. The vanes 40 are arranged symmetrically about the longitudinal axis of the flow directing assembly 30. In this embodiment, there are four such vanes 40, with each of the two interior vanes **40*a* canted outward from the vertical, and each of the two exterior vanes 40*b* canted a further amount from the vertical. The interior vanes 40*a* may be canted upwardly at an angle of between about 40° and about 60° from the vertical and the exterior vanes 40*b* may be at an angle of between about 80° and about 100° from the vertical. In one preferred embodiment, the interior vanes 40*a* are angled upwardly approximately 51° from the vertical, and the exterior vanes 40*b* approximately 90°. By carefuly selecting the angles of the directional vanes 40**, they produce, in combination with the other components of the invention, a substantially radial (180°) air flow pattern when the diffuser is viewed from an end. Embodiments with different numbers of directional vanes may also exist.

In one preferred embodiment of the radial flow diffuser, the directional vanes 40 are positioned at the angles described above and the side walls 38 of the perforated face panel 32 are also positioned at carefully chosen angles. According to this embodiment of the invention, the two side walls 38 directly attached to either side of bottom wall 36 are canted upwardly at approximately 110° from the vertical. The next pair of side walls are canted upwardly further, at an angle of approximately 144° from the vertical. The next, outermost pair of side walls 38a are substantially vertical, as described above.

Figure 9:
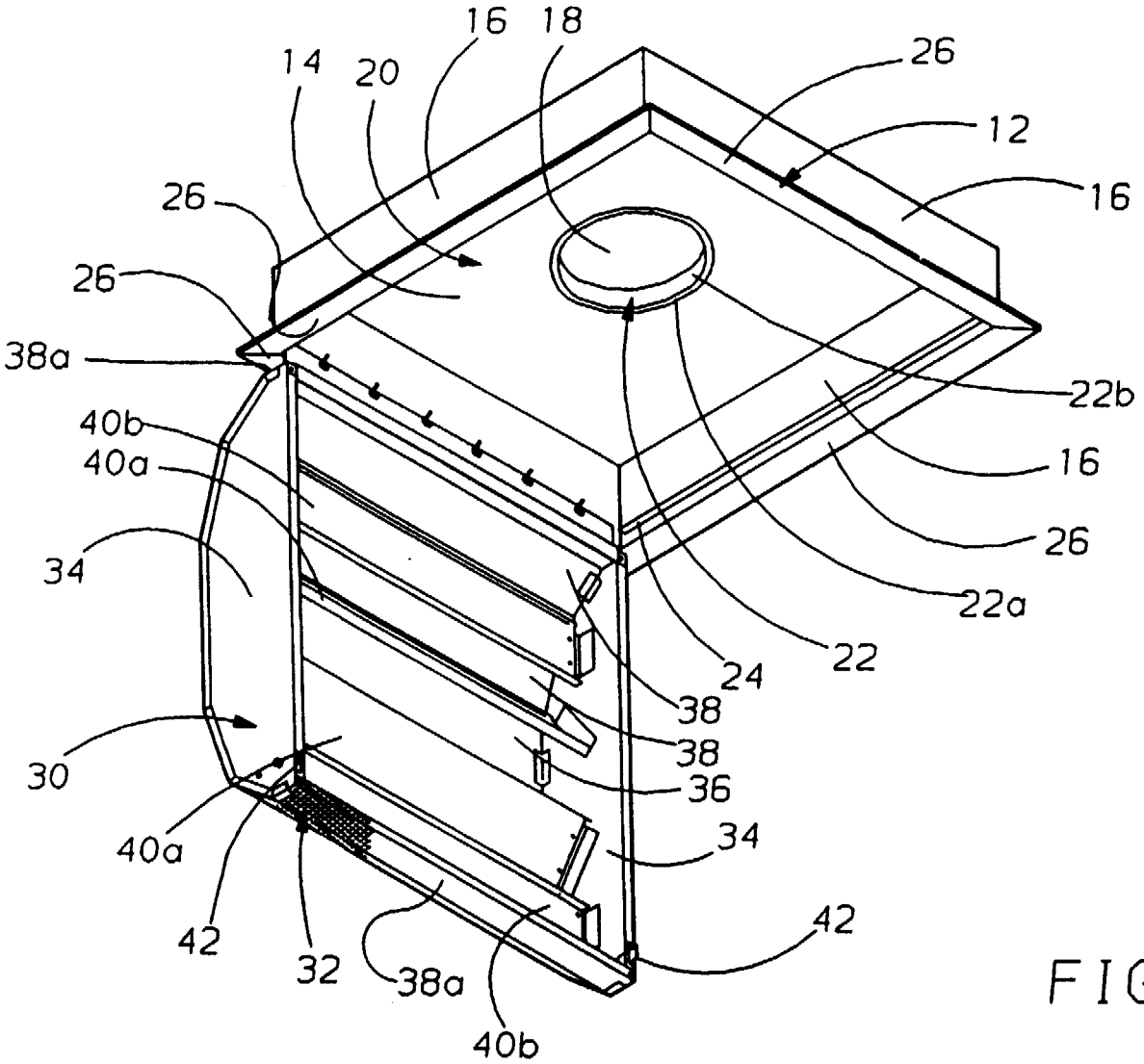
FIG. 9 is a perspective view from below of the preferred embodiment of FIG. 1 in which the flow directing assembly is swung away from the backpan assembly using its full length hinge.
Figure 10:
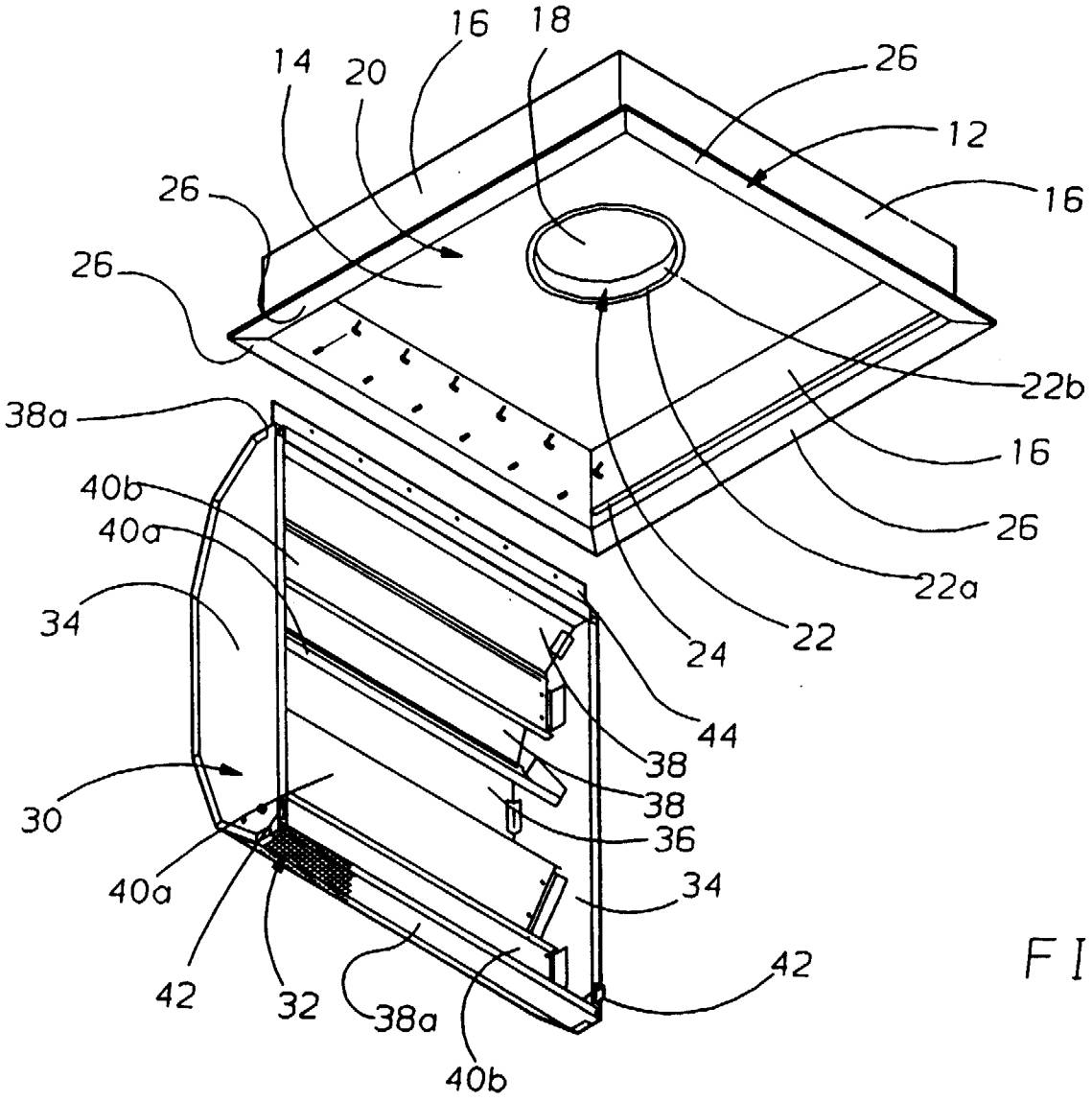
FIG. 10 is a perspective view from below of the preferred embodiment of FIG. 1 in which the flow directing assembly is separated from the backpan assembly using its quick release means.

Along one of the two vertical side walls 38a of the face panel 32 is a full-length hinge 44, which attaches to the side wall 16 of the backpan assembly 12 that lacks the inwardly projecting flange 24. The second vertical side wall 38a of the face panel 32 and the two end caps 34 are connected to the remaining three side walls 16 of the backpan assembly 12 by a plurality of pushbutton or other quick release latches 42. The quick release latches 42 and the hinging 44 are designed to allow the complete separation of the flow directing assembly 30 and the plenum 20 if required, as shown in FIG. 10. Alternatively, the flow directing assembly 30 may swing down from the hinge 44 to a vertical position as shown in FIG. 9. The connection between the backpan assembly 12 and the flow directing assembly 30 may be made by means other than quick release latches, for example, by screws and/or clips, but these means are not preferred.

The ability to open or remove the face panel 32 allows room side access to the interior of the radial flow diffuser without moving the backpan assembly 12. In addition, the absence of internal baffles or obstructions makes the plenum 20 fully accessible for cleaning. Ceiling integrity during cleaning is ensured, as there are no penetrations of the backpan 12 other than the inlet collar 22.

The radial flow diffuser may be mounted in the ceiling in a variety of ways that permit room side access to its interior. These include standard T-bar mounting (not shown) and surface mounting, in which the outwardly projecting flanges 26 of the backpan assembly 12 fit just below the ceiling.

In a preferred embodiment, the perforated face panel 32 and the directional vanes 40 are constructed from aluminum and the backpan assembly 12 from coated steel. Other appropriate materials or combinations of these materials would be obvious to someone skilled in the art.

The present invention could be used with HEPA (high efficiency particulate arrestor) filters, which could be located in the plenum 20. Such positioning is possible because of the lack of baffles or plates in the plenum.

A plurality of radial flow diffusers might be installed end-to-end, if desired, as the end caps 34 lack perforations.

Figure 11:
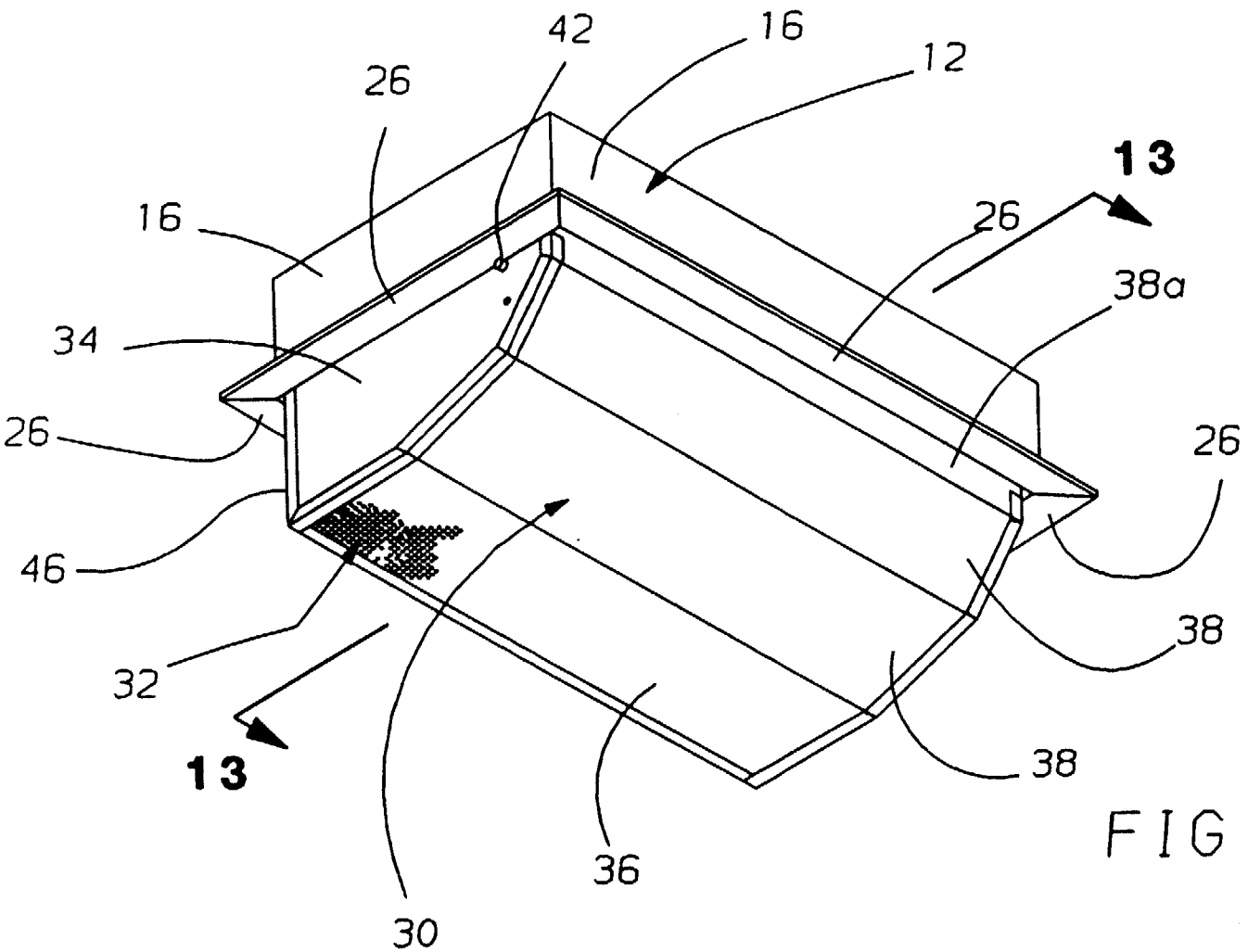
FIG. 11 is a perspective view from below of a second preferred embodiment of the invention for 90° air flow.
Figure 12:
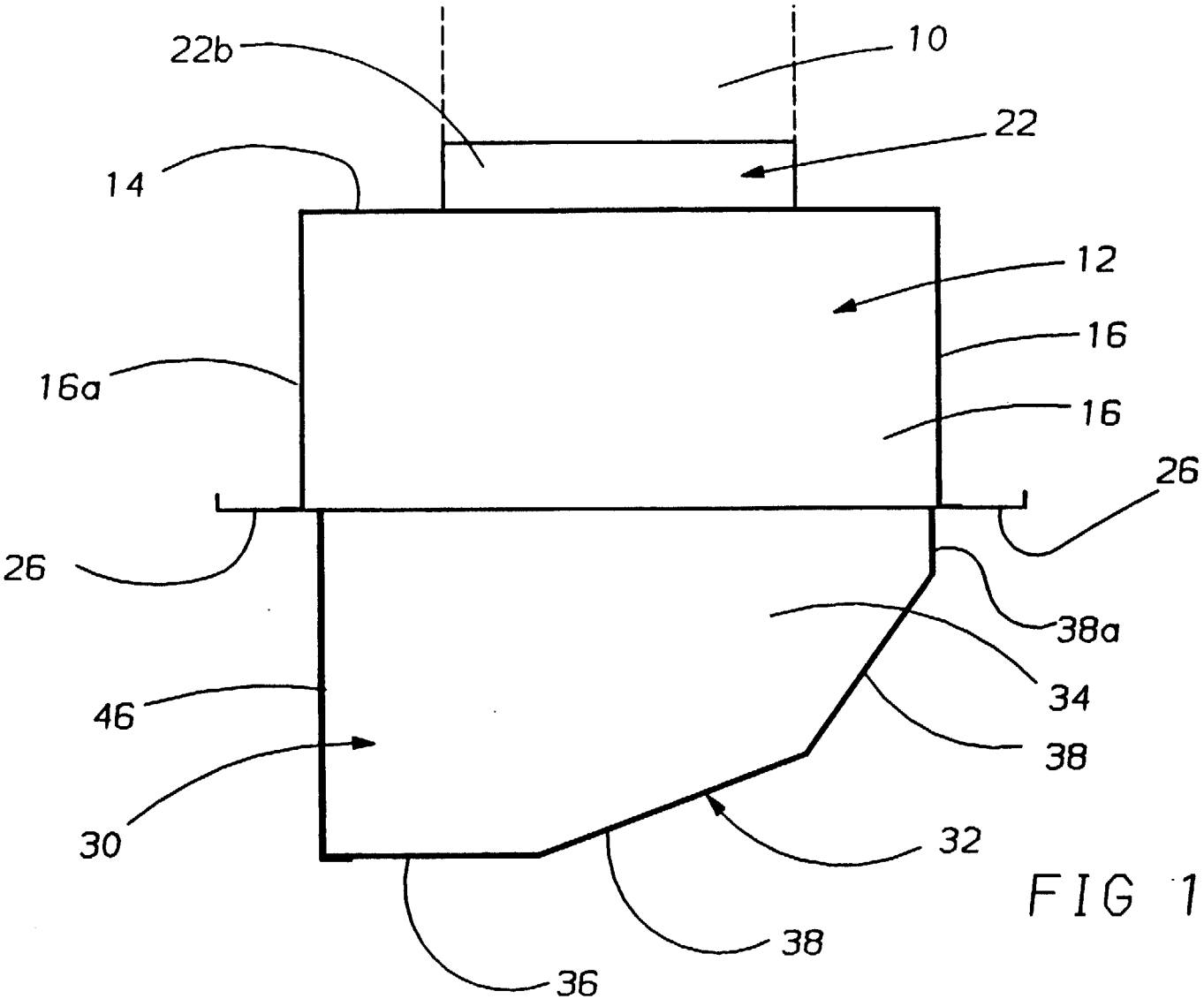
FIG. 12 is a plan view from the end of the embodiment of FIG. 11.
Figure 13:
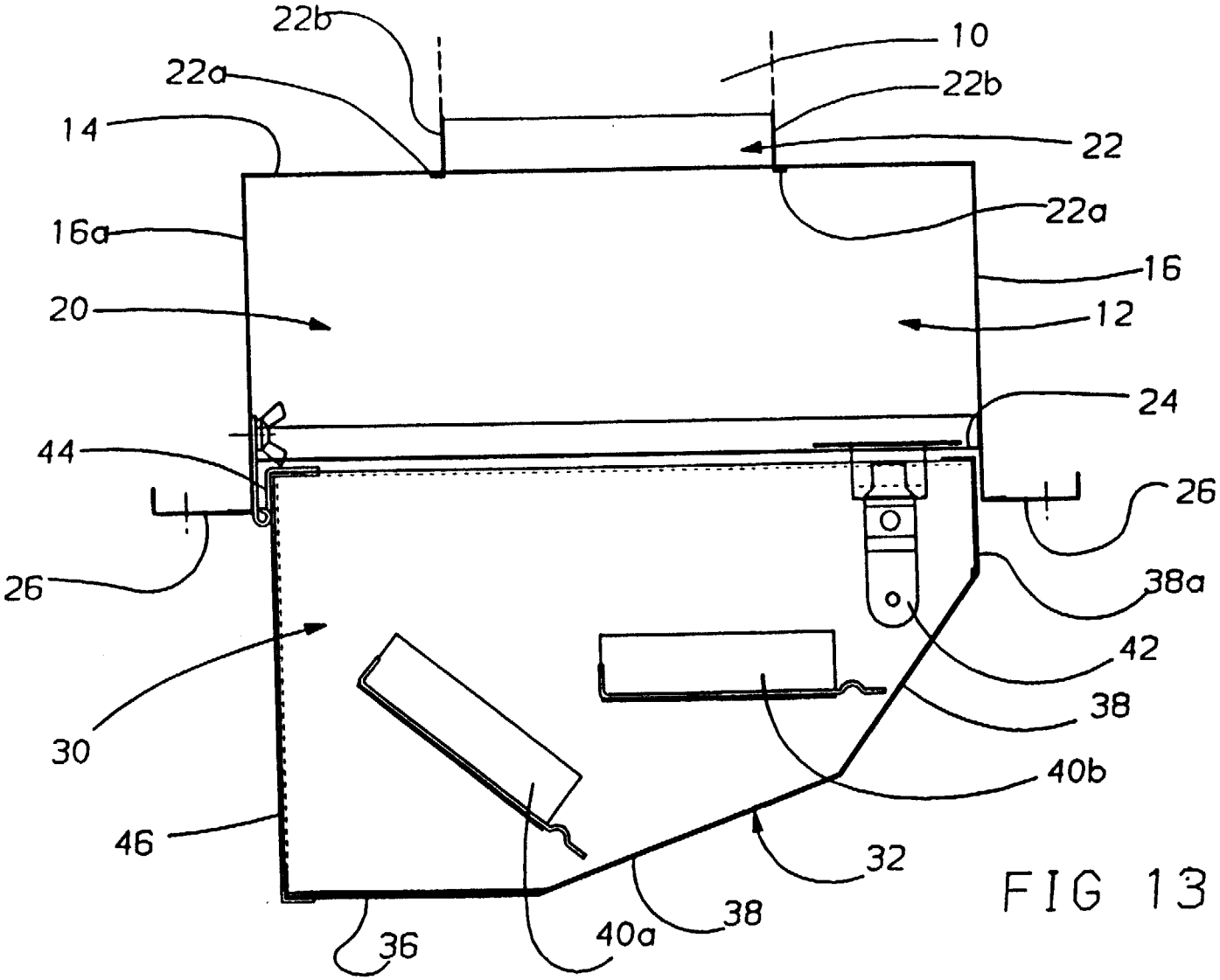
FIG. 13 is a cross-sectional view as indicated by the arrows 13—13 in FIG. 11.

In addition to the embodiment of the invention described above, which produces an approximately 180° air flow pattern, there exists a second embodiment (illustrated in FIGS. 11–13) that is similar in every respect except that it produces an approximately 90° air flow pattern. That is, the backpan assembly 12 is attached to "one-half" of the flow directing assembly 30 of the embodiment described above. In place of the central longitudinal axis of the flow directing component 30 are a side wall 16a of the backpan assembly 12 and a non-perforated, vertical side wall 46 of the face panel 32. The device has two or more directional vanes 40. This embodiment is preferred for certain applications in which the device is mounted directly adjacent to a room wall.

With its high capacity laminar-radial pattern combined with low sidewall exhausts, the present invention can "wash" a room with low velocity, non-mixing, clean, conditioned air. The washing pattern combines relatively short throws with large volumes of air, such that a room can be flushed rapidly.

The characteristics of the radial flow diffuser make it well-suited to applications requiring high rates of air change and particle flushing, with minimum room velocity. These include laboratories, vivariums, operating rooms and clean rooms. The device's draftless, low velocity washing air pattern would not disturb experiments, equipment operation or personnel comfort, and might aid in maintaining a constant temperature despite the high heat loads common to these applications. As turbulence and entrainment of room air are minimal, the risk of cross-contamination by airborne disease is also minimized.

Laboratories with fume hoods present an unique air distribution problem. For fume hoods to operate correctly and without "spillage" from their work opening, the supply air diffuser should produce terminal air velocities at the hood face no higher than ½ to ⅔ the rated face velocity of the hood. The present invention's ability to produce relatively short throws with large volumes of air allows it to be used in closer proximity to a fume hood than conventional diffusers, without disturbing the hood's face air flow pattern. Similarly, this invention's ability to reduce air flow velocity rapidly allows radial flow diffusers to be placed closer to each other without risk of high velocity air Jets colliding and consequently producing drafts and personnel discomfort.

For air distribution devices in general and for these specialized applications in particular, ease in cleaning and servicing is highly desirable. For example, odor control of vivariums depends substantially on the ability to clean room surfaces. The present invention, with its face panel attached by quick release latches and a hinge, is simple to clean and service. Upon opening the face panel, the plenum is completely unobstructed and easily accessible. It is possible to remove the entire flow directing assembly to clean and even sterilize it.

In certain other devices, this kind of easy access to the plenum is not possible because the backpan rests on the face panel. The entire device must be removed from the ceiling for cleaning. Such removal is especially undesirable in clean room applications. In addition, it involves the use of a flexible duct connector on the inlet, which may also be undesirable.

The present invention is easy to tool and manufacture, given its simple design with only flat surfaces in vertical, horizontal and angular planes. Unlike certain other devices designed for radial air distribution, it does not require complex design or curved surfaces.

What is claimed is:

1. An air distribution device for use with an air inlet opening in a ceiling of a room for effecting a high capacity, non-aspirated flow of air into the room with short throw and minimal turbulence, the device comprising:

a box-shaped backpan for connection to the air inlet opening; and a front air flow directing assembly connected to the backpan, the flow directing assembly including (i) a front face having perforations therethrough;

(ii) a pair of end caps, the face connected between the end caps such that substantially all of the air flow from the inlet is directed through the perforations; and (iii) a plurality of pairs of directional control vanes fixedly connected between the end caps to span the distance therebetween, each vane of each pair being oriented symmetrically about a center plane of the device with respect to the other of the pair; and wherein the face includes a plurality of planar surfaces, including a front planar surface orthogonal to the center plane and a plurality of pairs of angled planar surfaces, each surface of each pair of angled planar surfaces being angled toward the backpan and oriented symmetrically about the center plane with respect to the other of the pair and each vane being angled with respect to the center plane such that, in use, air issues outwardly of the device in a radial flow pattern when viewed from an end.

2. The air distribution device of claim 1, wherein the planar surfaces are each substantially rectangular.

3. The air distribution device of claim 2, wherein each surface of the pair of angled planar surfaces farthest from the center plane is substantially parallel to the center plane.

4. The air distribution device of claim 3, wherein the number of pairs of angled planar surfaces is three.

5. The air distribution device of claim 4, wherein the number of pairs of directional control vanes is two.

6. The air distribution device of claim 5, wherein:

each vane of the pair of directional vanes closest to the center plane is canted toward the backpan at a forward angle of approximately 40° to 60° from the center plane; and each vane of the pair of directional vanes farthest from the center plane is canted toward the backpan at a forward angle of approximately 80° to 100° from the center plane.

7. The air distribution device of claim 6, wherein:

each vane of the pair of directional vanes closest to the center plane is canted toward the backpan at a forward angle of approximately 51° from the center plane; and each vane of the pair of directional vanes farthest from the center plane is canted toward the backpan at a forward angle of approximately 90° from the center plane.

8. The air distribution device of claim 7, wherein:

each of the surfaces of the pair of angled surfaces adjacent to the front planar surface is angled toward the backpan at a forward angle of approximately 110° from the center plane; and each of the surfaces of the pair of angled surfaces adjacent to the surfaces at a forward angle of approximately 110° from the center plane is canted toward the backpan at a forward angle of approximately 144° from the center plane.

9. The air distribution device of claim 1, 3, 6 or 8, wherein the perforations of the front face are of the size ranging from approximately 1/16 inch in diameter to approximately 3/16 inch in diameter.

10. The air distribution device of claim 9, wherein the area of the front face having perforations is in the range of 5% to 55%.

11. The air distribution device of claim 1, 3, 6 or 8, wherein the backpan is hingedly attached to the flow directing assembly.

12. An air distribution device for use with an air inlet opening in a ceiling of a room for effecting a high capacity, non-aspirated flow of air into the room with short throw and minimal turbulence, the device comprising:

a box-shaped backpan for connection to the air inlet opening; and a front air flow directing assembly connected to the backpan, the flow directing assembly including (i) a side wall;

(ii) a front face adjoining the side wall, the front face having perforations therethrough;

(iii) a pair of end caps, the side wall and the face connected between the end caps such that substantially all of the air flow from the inlet is directed through the perforations; and (iv) a plurality of directional control vanes fixedly connected between the end caps to span the distance therebetween; and wherein the face includes a plurality of planar surfaces, including a front planar surface adjacent and orthogonal to the side wall and a plurality of planar surfaces angled toward the backpan such that, in use, air issues outwardly of the device in a radial flow pattern when viewed from an end.

13. The air distribution device of claim 12, wherein the planar surfaces are each substantially rectangular.

14. The air distribution device of claim 13, wherein the angled planar surface farthest from the side wall is substantially parallel to the side wall.

15. The air distribution device of claim 14, wherein the number of angled planar surfaces is three.

16. The air distribution device of claim 15, wherein the number of directional control vanes is two.

17. The air distribution device of claim 16, wherein:

the directional vane closest to the side wall is canted toward the backpan at a forward angle of approximately 40° to 60° from a plane containing the side wall; and the directional vane farthest from the side wall is canted toward the backpan at a forward angle of approximately 80° to 100° from the plane containing the side wall.

18. The air distribution device of claim 17, wherein:

the directional vane closest to the side wall is canted toward the backpan at a forward angle of approximately 51° from the plane containing the side wall; and the directional vane farthest from the side wall is canted toward the backpan at a forward angle of approximately 90° from the plane containing the side wall.

19. The air distribution device of claim 18, wherein:

the angled surface adjacent to the front planar surface is angled toward the backpan at a forward angle of approximately 110° from the plane containing the side wall; and the angled surface adjacent to the surfaces at a forward angle of approximately 110° from the side wall is canted toward the backpan at a forward angle of approximately 144° from the plane containing the side wall.

20. The air distribution device of claim 14, wherein the perforations of the front face are of the size ranging from approximately 1/16 inch in diameter to a approximately 3/16 inch in diameter.

21. The air distribution device of claim 14, wherein the backpan is hingedly attached to the flow directing assembly.

* * * * *